United States Patent [19]

Staniszewski

[11] Patent Number: 4,714,243

[45] Date of Patent: Dec. 22, 1987

[54] PAPER TRAY FOR A PRINTING DEVICE

[75] Inventor: Tadeusz Staniszewski, Budd Lake, N.J.

[73] Assignee: Ziyad Incorporated, Denville, N.J.

[21] Appl. No.: 823,472

[22] Filed: Jan. 28, 1986

[51] Int. Cl.[4] ..... B65H 1/00

[52] U.S. Cl. ..... 271/171; 271/22; 271/127; 400/624

[58] Field of Search ..... 271/22, 127, 171; 400/624

[56] References Cited

U.S. PATENT DOCUMENTS

| | | | |
|---|---|---|---|
| 1,914,849 | 6/1933 | Davidson . | |
| 3,689,064 | 9/1972 | Kuksa | 271/127 X |
| 4,326,815 | 4/1982 | Kapp . | |
| 4,422,631 | 12/1983 | Sugizaki | 271/127 X |
| 4,487,406 | 12/1984 | Kabashima | 271/127 |
| 4,529,189 | 7/1985 | Konishi | 271/171 X |
| 4,544,294 | 10/1985 | Runzi . | |
| 4,558,858 | 12/1985 | Runzi | 271/127 X |
| 4,565,360 | 1/1986 | Runzi | 271/127 X |

*Primary Examiner*—Richard A. Schacher

*Attorney, Agent, or Firm*—Lerner, David, Littenberg, Krumholz & Mentlik

[57] ABSTRACT

A paper tray for a printing device is disclosed having a pair of paper supporting members, movable relative to one another, for supporting the lateral sides of a stack of individual sheets of paper. The movability of the paper supporting members relative to one another allows the paper tray to accommodate stacks of individual sheets of paper having different widths or size. The paper supporting members are provided with a concave paper supporting surface such that the stack of individual sheets of paper assumes a concave shape, thereby having sufficient mechanical strength to be self-supporting in the unsupported region between the paper supporting members. The curved shape of the stack is provided, in part, by a forwardly arranged paper pressing plate which is rotatable about an axis spaced from the rotational axis of a control rod which is adapted for rotating the paper pressing plate into a position for replenishing the individual sheets of paper within the stack. As the stack is depleted, the paper pressing plate maintains engagement of the top sheet of paper within the stack with a pair of spaced apart paper feed rollers, whose operation supplies the top sheet to the platen of the printing device.

21 Claims, 5 Drawing Figures

PAPER TRAY FOR A PRINTING DEVICE

BACKGROUND OF THE INVENTION

The present invention relates in general to a mechanical, demand-type, paper sheet feeder for feeding pre-cut sheets of paper or envelopes from different paper trays into a rotating printer platen. More specifically, the paper sheet feeder includes various feed rollers associated with the different paper trays, which paper trays are constructed to facilitate storage of stacks of individual sheets of paper having different widths by a simple adjustment of the spaced apart relationship between a pair of lateral paper supporting members. In this regard, the lateral paper supporting members are arranged in operative association with a control rod to facilitate the replenishment of paper in the stack, while maintaining the top sheet of paper within the stack in engagement with the various feed rollers for feeding sheets of paper and envelopes into the rotating printer platen.

Tremendous advances have been made in the last few years in automating office procedures. Conventional typewriters have grown into mini-computers for performing word processing, storage and other functions. The speed at which these machines produce words on paper is increasing at a rapid rate. As added speed and sophistication are developed into such machines, the actual putting of words onto paper becomes ancillary to the main function of collecting and organizing the information into a format to be printed. In order to have flexibility and speed, many systems have been developed where an operator manipulates words on a cathode ray tube or other word processing equipment until the final copy is in the format desired. With all of these advantages, it has developed that today one of the major bottlenecks in terms of time, and therefore usefulness of this equipment, is the rate at which paper can be brought to and moved past a printing head to produce the final hard copy.

Of course, it is possible to use continuous sheets of perforated paper, as is commonly done in computer applications, having sprocket holes along the sides thereof to continuously feed and move the paper through an impact printer. This, however, requires special paper which is not suitable to the many requirements for which normal typewriting is employed.

Many machines exist, both copying machines and printing machines, which automatically feed paper past a printing or reproducing station. These machines are normally run synchronously such that prior to the time the paper is fed, the information to be printed on the paper is already organized and the papers move past the printing head in a continuous fashion. This is not generally suitable for impact printing devices, since impact printing is accomplished with the paper stationary rather than moving, and further the adaption of normal typewriting type printing requires moving of paper not only in an intermittent basis, but also in the forward and reverse direction in accordance with the information to be typed. Still further, with such existing equipment, it is generally not possible to manually feed separate sheets of paper, which may be of different size or thickness such as, for example, envelopes, without disconnecting the equipment from the printing machine.

In U.S. Pat. No. 4,326,815, which patent is assigned to the same assignee of the present invention, there is disclosed a paper sheet feeding apparatus, including a removable paper tray, which is capable of being retrofitted with respect to existing printing devices, i.e., distributed as an after market product, as well as being capable of being sold and distributed with the printing device. The retrofit characteristic of this paper sheet feeding apparatus lends itself to conform to the climate of the existing impact printing devices, rather than requiring the radical modification thereof, so as to conform with the needs of high speed paper feeding. Although the known paper sheet feeding apparatus has been commercially successful, such apparatus requires the use of dedicated paper trays for each different width or size of paper being used. This necessitates the removal of one paper tray and its replacement with a paper tray of a different size if paper having a different width is desired. As such, one must maintain, on hand, an inventory of paper trays of varying size to accommodate the different needs of the user.

Another paper feeding apparatus adapted to be retrofitted onto an existing printing device is known from U.S. Pat. No. 4,544,294. In accordance with this known paper sheet feeding apparatus, a pair of spaced apart rocker plates having a flat bottom support the lateral sides of a stack of individual sheets of paper. The rocker plates are slideable relative with respect to each other along a cross rod, as well as being rotatable or pivotable thereabout, so as to accommodate stacks of sheets of paper of different widths. However, as the rocker plates are spaced apart, the central portion of the stack remains unsupported and often sags, which can have the tendency to cause individual sheets of paper to be misfed. In addition, the requirement that the entire rocker plate be rotatable or pivotable about the cross rod for engaging the upper sheet of paper of the stack with its associated paper feed rollers, results in a construction which is relatively complicated to assemble, as well as to perform periodic maintenance. Another paper sheet feeding apparatus of the latter type is known from U.S. Pat. No. 1,914,849.

Accordingly, it can be appreciated that there is an unsolved need for a paper tray for a printing device which readily accommodates stacks of individual sheets of paper having different widths or size and which is simple in construction to facilitate assembly and the maintenance thereof.

SUMMARY OF THE INVENTION

It is broadly an object of the present invention to provide a paper tray for a printing device which overcomes or avoids one or more of the foregoing disadvantages resulting from the use of the above mentioned prior art paper sheet feeding apparatus, and which fulfills the specific requirements of such a paper tray for accommodating stacks of individual sheets of paper having different widths or size for use in a paper sheet feeding apparatus adapted to be retrofitted to a printing device.

Another object of the present invention is to provide a paper tray for a printing device which accommodates stacks of individual sheets of paper having different widths or size without the necessity of having to provide dedicated paper trays.

In accordance with one embodiment of the present invention, there is disclosed a paper tray for storing a stack of individual sheets of paper to be fed therefrom to a printing device, the paper tray being constructed of first paper supporting means for supporting one lateral portion of the stack, second paper supporting means, the first and second paper supporting means each providing a concave paper supporting surface for supporting another lateral portion of the stack, and a support guide movably supporting the first and second paper supporting means in spaced apart relationship to accommodate stacks of individual sheets of paper having different widths between their lateral portions, whereby the stack supported on the concave paper supporting surface assumes a concave shape to be self-supporting in an unsupported region between the first and second paper supporting means.

In accordance with another embodiment of the present invention, there is disclosed a paper tray for storing a stack of individual sheets of paper to be fed therefrom to a printing device, the paper tray being constructed of paper supporting means for supporting the stack, paper feeding means for feeding individual sheets of paper from the stack, paper pressing means movably mounted about a first axis to the paper supporting means, the paper pressing means movable about the first axis towards the paper feeding means for urging the stack into engagement therewith and away from the paper feeding means for supplying individual sheets of paper to the stack, and control means movable about a second axis spaced from the first axis, the control means engaging a portion of the paper pressing means for moving the paper pressing means about the first axis and away from the paper feeding means.

BRIEF DESCRIPTION OF THE DRAWINGS

The description, as well as further objects, features and advantages of the present invention will be more fully understood by reference to the following detailed description of a presently preferred, but nonetheless illustrative, paper tray for a printing device in accordance with the present invention, when taken in conjunction with the accompanying drawings wherein.

DETAILED DESCRIPTION

Figure 1:
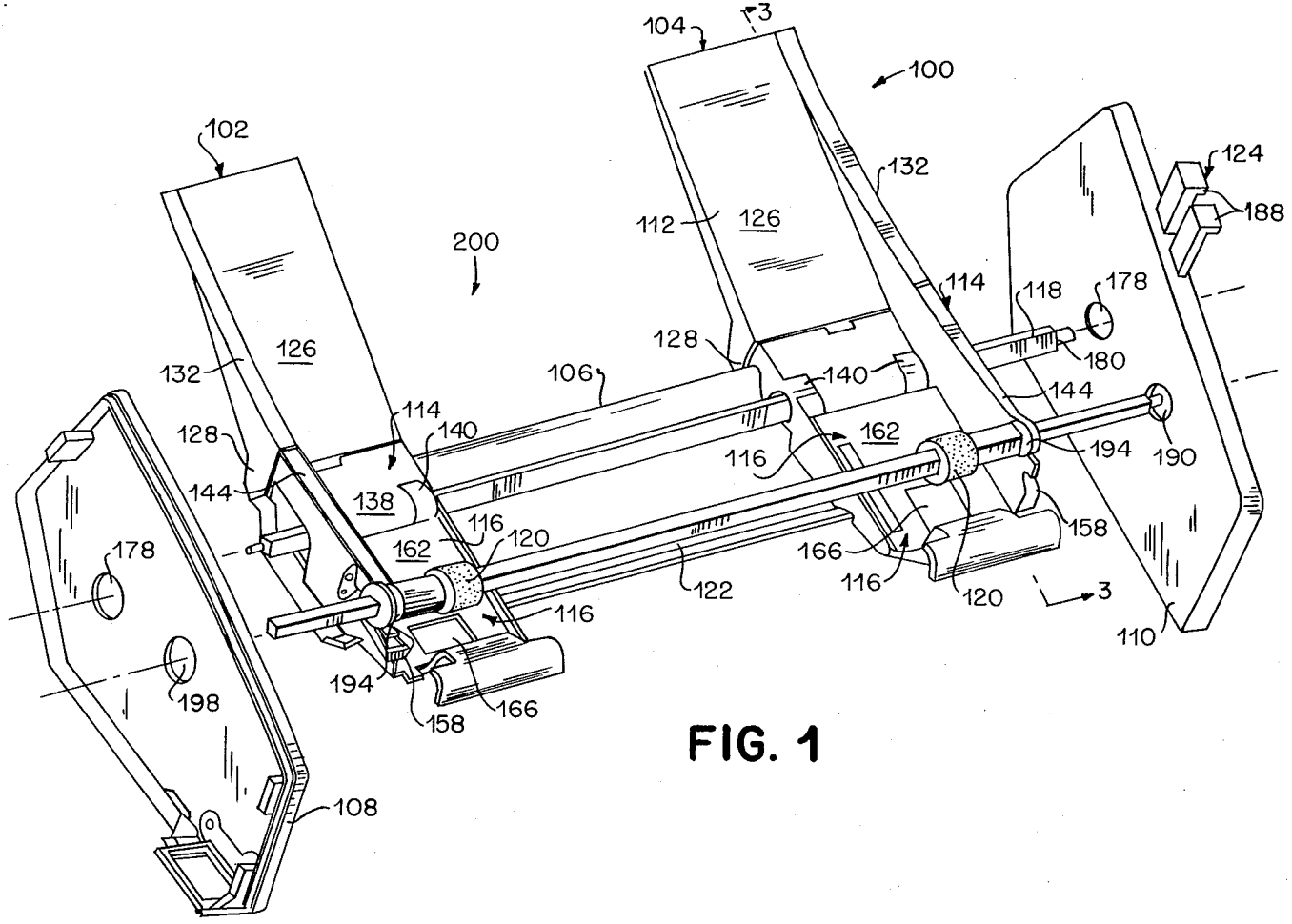
FIG. 1 is a perspective view, partially exploded, of a paper tray constructed in accordance with the present invention, showing a pair of spaced apart paper supporting members slidably mounted to a support guide affixed to a pair of spaced apart frame members.

Referring now to the drawings wherein like reference numerals represent like elements, there is shown in FIG. 1 a paper tray generally designated by reference numeral 100 and adapted to be mounted onto a printing device for operation in conjunction therewith. Such printing devices generally include a rotatable, transversely extending printer platen which is adapted to rotate about a transversely extending shaft, and a movable print head which is adapted to tranverse, back and forth, across the transverse length of the platen. As is conventional, a sheet of paper to be printed on by the print head is received between the platen and a pressure roller in engagement with the platen for advancing a sheet of paper to the print head. The print head is carried by a movable carriage which traverses across the transverse extent of the platen by means of a suitable carriage motor. The print head is arranged to be closely spaced from the platen so that printing, in lines, is achieved on the sheet of paper as the print head traverses between the ends of the platen. During the printing operation, the platen serves to rotate intermittently to advance the sheet of paper longitudinally relative to the print head for the printing of the next line thereon by virtue of the transverse movement of the print head with respect thereto. This printing operation may be as in a conventional typewriter, from left to right, or the printing may be from left to right on one line of print, with the next line of print being effected by movement of the print head from right to left. This latter means of printing is commonly used in many present day word processing systems.

The paper tray 100, in accordance with the present invention, is mainly designed for use with printing devices having automatic printing or typing capabilities, i.e., printing systems or devices in which a complete page of print is effected automatically without or with a minimal amount of instructions from the user. In such systems, the text of the matter to be printed may have been previously stored on a disk or other similar recording device, or may be in the memory of a cathode ray tube on which a user has completed work to arrange the matter or information in a desired format. When desired, the system simply prints the desired information onto sheets of paper.

Generally, in the printing operation, the matter or information is printed one line at a time, with the sheet of paper then being automatically advanced for effecting printing of the next line, and so on until an entire page is printed. Such printing devices are generally of the impact printing type, i.e., the print head impacts the sheet of paper against the platen to effect the printing. However, it should be appreciated that the paper tray 100 could also be used with other types of printing devices such as, for example, ink jet printers, line printers, and/or nonimpact electrostatic printers.

Figure 2:
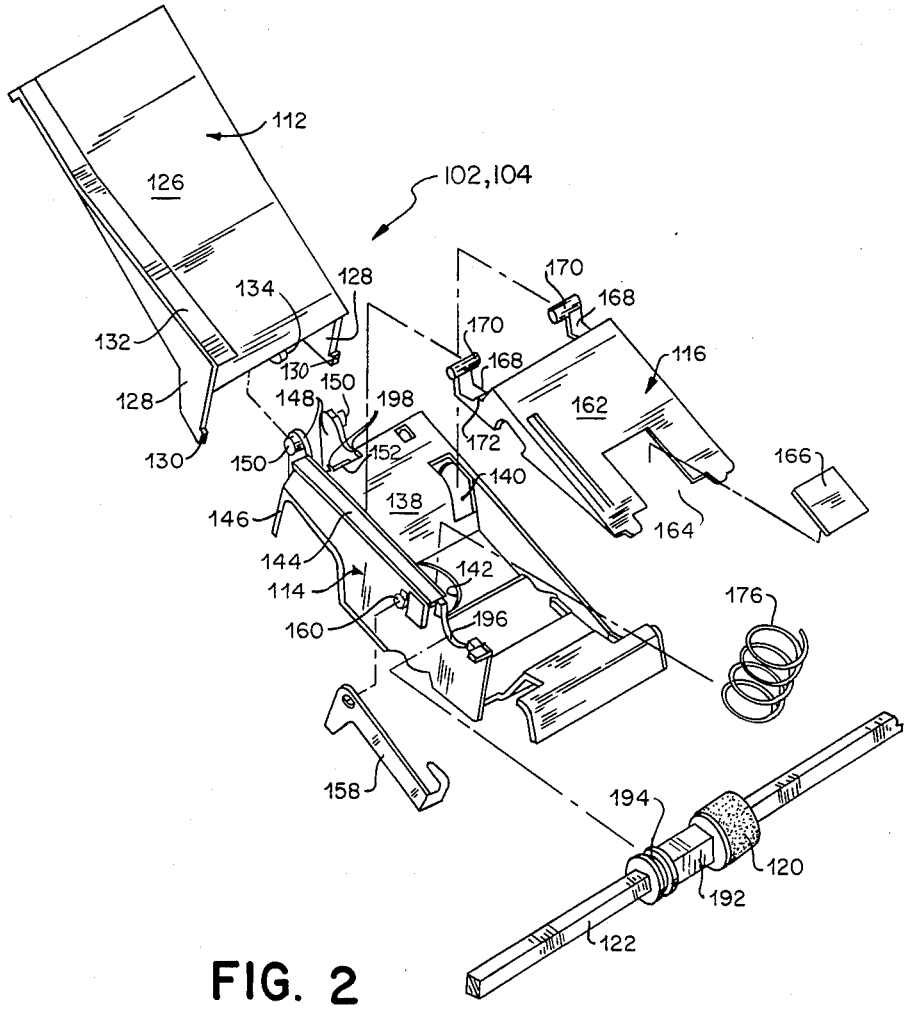
FIG. 2 is an exploded perspective view of one paper supporting members in disassembled arrangement, showing the paper supporting members including a first and second paper support, with the second paper support provided with a rotatable or pivotable paper pressing plate.

As will be appreciated by the description hereinbelow, the paper tray 100, in accordance with the present invention, is particularly well adapted to be retrofitted with such printing devices. As shown in FIGS. 1 and 2, the paper tray 100 is constructed of a pair of paper supporting members 102, 104 slidably mounted to a paper guide 106 secured between a pair of parallel spaced apart side frame members 108, 110. Each of the paper supporting members 102, 104 is generally constructed to include an extended first paper support 112, a base second paper support 114 and a paper pressing plate 116. As to be described in further detail, each of the paper supporting members 102, 104 are arranged in operative association with a control rod 118 and one or more paper feed rollers 120 mounted onto a rotatable paper faced shaft 122. A control assembly 124, as best shown in FIG. 5, is operative for rotating or pivoting the control rod 118.

Figure 3:
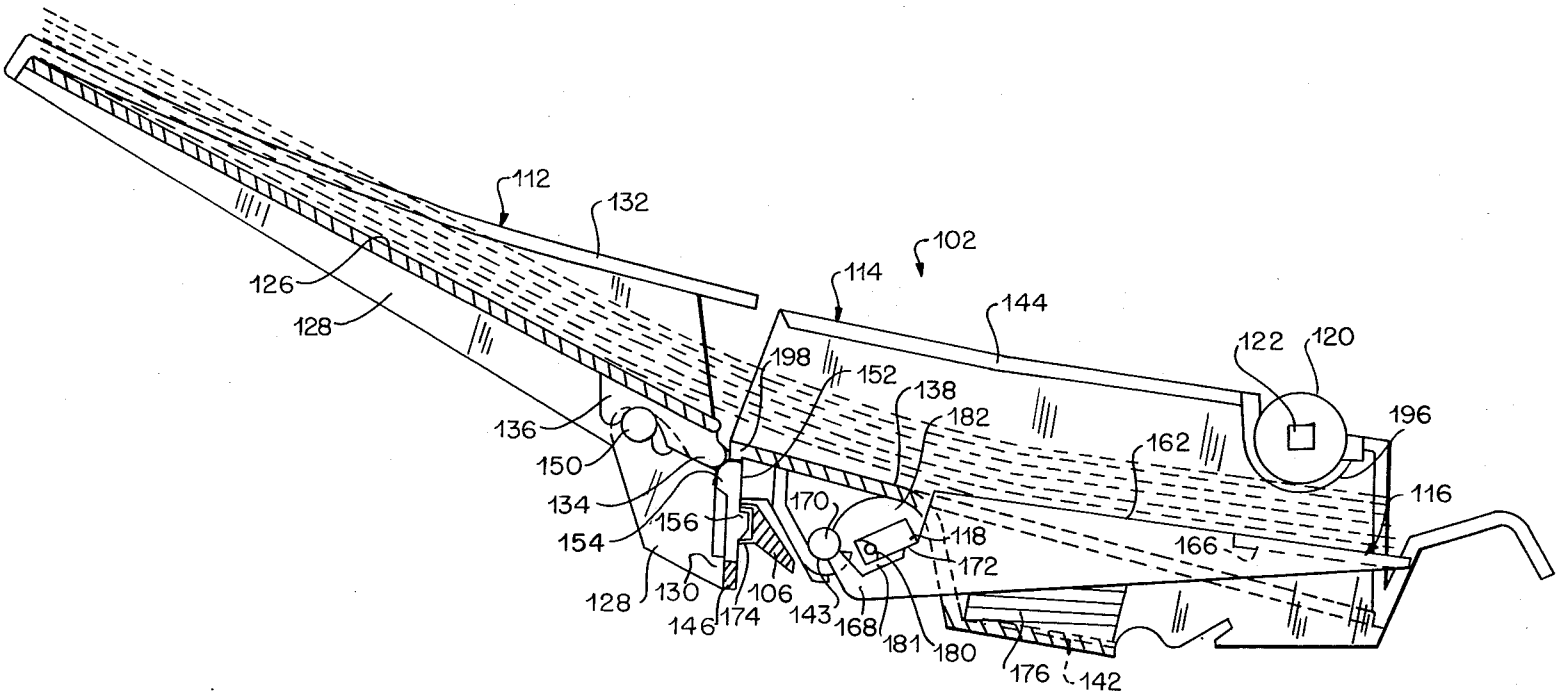
FIG. 3 is a partial cross-sectional view of one paper supporting members taken generally along Line 3—3 of FIG. 1, showing the first and second paper supports providing a concave paper supporting surface and an eccentrically mounted control rod arranged in operative association with the paper pressing plate for urging the top sheet of paper within the stack into engagement with its associated paper feed rolls.

Referring now to FIGS. 2 and 3, the extended first paper support 112 is constructed of a planar support 126, a pair of spaced apart downwardly extending legs 128 each having a forwardly projecting tab 130, a single upstanding sidewall 132, an outwardly extending projection 134 arranged between the extending legs, and a pair of spaced apart bearing members 136 arranged on either side of the projection. The base second paper support 114 is constructed of a contoured support 138 having a pair of spaced apart rearward openings 140 and a central recess 142, a J-shaped bearing member 143 projecting downwardly from the contoured support in alignment with the rearward openings, a single upstanding side wall 144, a rear wall 146 supporting a pair of spaced apart rearwardly extending brackets 148 each provided with a laterally projecting hub 150, a locking tab 152 arranged between the brackets and having an upper rearwardly projecting bulge 154 and a central forwardly projecting guide rib 156, and a paper separater 158 pivolly mounted to a hub 160 projecting from the upstanding side wall. The paper pressing plate 116 is constructed of a planar support 162, a central forward recess 164 for receiving a friction pad 166, and a pair of spaced apart rearwardly extending brackets 168 each provided with a laterally projecting hub 170 and a raised pad 172.

Referring now to FIGS. 1 and 3, the extended first paper support 112, base second paper support 114 and paper pressing plate 116 are shown in assembled relationship. Specifically, the second paper support 114 is slidably mounted onto the paper guide 106 between the side frame members 108, 110. The paper guide 106 is provided with a rearwardly facing longitudinally extending channel 174 adapted to capture the guide rib 156 provided on the locking tab 152. The paper pressing plate 116 is arranged overlying the contoured support 138 and having its brackets 168 extending through the openings 140 of the base second paper support 114. A portion of the projecting hubs 170 of the brackets 168 are rotationally or pivotally captured within the J-shaped bearing members 143 of the base second paper support 114. In this manner, the paper pressing plate 116 can rotate or pivot about a first axis provided by the hubs 170. A bias spring 176 is retained within the recess 142 of the base second paper support 114 for urging the paper pressing plate 116 upwardly towards the paper feed rollers 120. The control rod 118 is arranged transversely extending across the brackets 168 of the paper pressing plate 116 and having its ends extending through openings 178 provided within the side frame members 108, 110. The control rod 118 is operative for eccentric rotation about a second axis 180 which is spaced from the first axis of rotation of the hub 170 of the paper pressing plate 116 via the J-shaped bearing members 143. The leading edge of the control rod 118 engages the raised pads 172 of the paper pressing plate 116 while providing a space 181 with the remaining underlying portion of the brackets 168.

Figure 5:
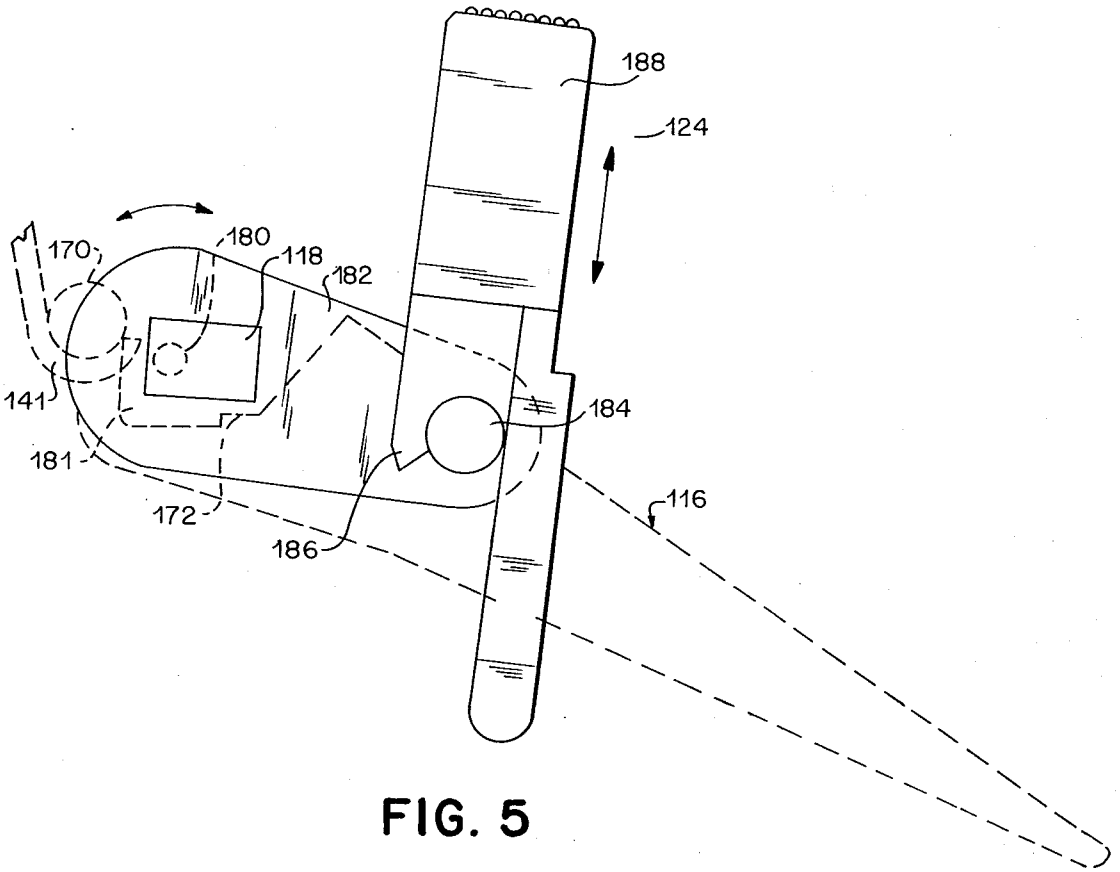
FIG. 5 is a front elevational view of an assembly adapted for pivoting the paper pressing plate by rotation of the control rod.

The end of the control rod 118, extending through the side frame member 110, is attached to the control assembly 124 as shown in FIG. 5. The control assembly 124 is constructed of a lever 182 attached at one end to the control rod 118 and provided with a projecting hub 184 at the other end thereof. The hub 184 is captured within a bearing 186 of a control arm 188. The control arm 188 is biased by a spring (not shown) for normally rotating the control rod 118 by the lever 182 in a conterclockwise direction as viewed in FIG. 5. As such, the paper pressing plate 116 is rotated or pivoted about hub 170 in a counterclockwise direction under the influence of the bias spring 176 provided between the paper pressing plate and the base second paper support 114. The paper feed shaft 122 is arranged extending transversely across the base second paper support 114 and having its ends extending through openings 190 provided within the side frame members 108, 110. The paper feed shaft 122 is attached to an assembly (not shown) adapted to cause the rotation thereof for feeding individual sheets of paper by means of rotation of the paper feed rollers 120. To this end, as shown in FIG. 2, the paper feed rollers 120 are provided with an extension 192 having a double flanged portion 194 adapted for capturing a recessed edge 196 of the upstanding side wall 144 of the base second paper support 114. As a result of this arrangement, the paper feed roller 120 is arranged overlying the forward central portion of the base second paper support 114, and more specifically, generally overlying the friction pad 166 of the paper pressing plate 116.

Figure 4:
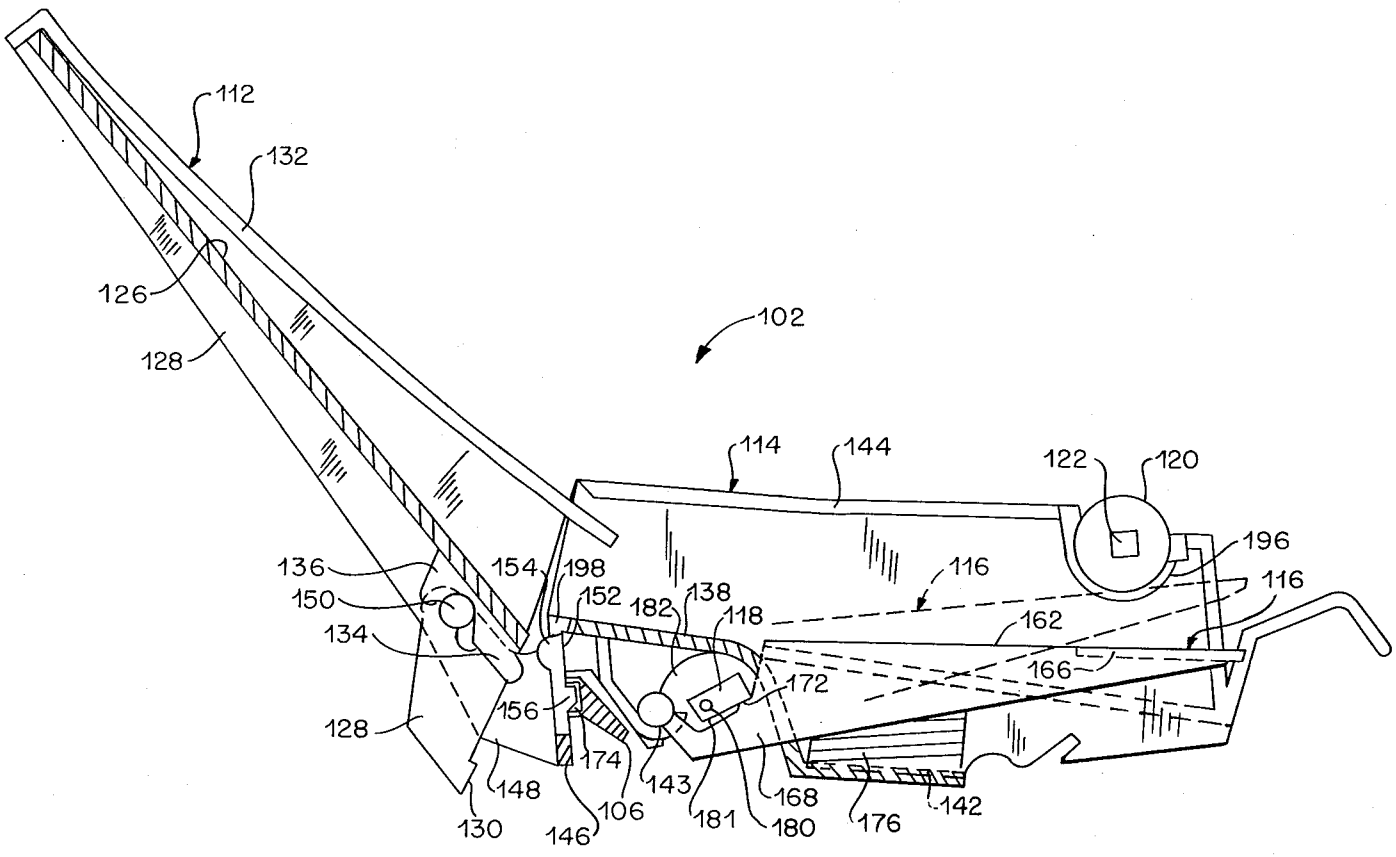
FIG. 4 is a partial cross-sectional view illustrating the paper tray as shown in FIG. 4 having the first paper support arranged in an unlocked position to permit sliding movement of the paper supporting member along the support guide.

The extended first paper support 112 is rotatably or pivotally mounted to the base second paper support 114 by capturing the hubs 150 projecting from the brackets 148 within the bearing members 136 underlying the planar support 126 of the extended first paper support. In this manner, the extended first paper support 112 is adapted for rotational or pivotable movement with respect to the base second paper support 114. Specifically, the extended first paper support 112 is rotatable between a locked position as shown in FIG. 3 and an unlocked position as shown in FIG. 4. in the locked position, the projection 134 of the extended first paper support 112 engages the bulge 154 provided on the locking tab 152 of the base second paper support 114. As the locking tab 152 is formed between two spaced apart cutouts 198 on the rear wall 146 of the base second paper support 114, see FIG. 2, the locking tab is resiliently flexible. As the projection 134 engages the bulge 154, the locking tab is pressed against a portion of the paper guide 106 forming the channel 174 which has captured the guide rib 156. This pressing of the locking tab 152 against the paper guide 106, prevents sliding movement of the paper supporting members 102, 104 relative to the paper guide. Similarly, rotation of the extended first paper support 112 in a clockwise direction into its unlocked position as shown in FIG. 4, causes disengagement of the projection 134 from the bulge 154. As a result, the paper supporting members 102, 104 may be moved longitudinally along the paper guide 106 to accommodate a stack of individual sheets of paper having different widths or size.

The operation of the paper tray 100, in accordance with the present invention, will now be described. Referring to FIGS. 1, 3 and 4, a pair of paper supporting members 102, 104 are mounted onto the paper guide 106 in spaced apart relationship. With the extended first paper support 112 rotated clockwise about hub 150 of the base second paper support 114, the projection 134 is disengaged from the bulge 154 of the locking tab 152 to permit free sliding movement of the paper supporting members 102, 104 along the longitudinal axis of the paper guide 106 between the side frame members 108, 110. The paper supporting members 102, 104 can be positioned such that the distance between their respective upstanding side walls 132, 144 correspond to the width or size of the stack of paper to be fed therefrom by operation of the paper feed rollers 120 via rotation of the paper feed shaft 122. Once the paper supporting members 102, 104 have been positioned appropriately, the respective extended first paper supports 112 are rotated counterclockwise about the hub 150 to cause engagement of the projection 134 with the bulge 154 of the locking tab 152. Upon engagement, the locking tab 152 is urged against that portion of the paper guide 106 defining the channel 174 which has captured the guide rib 156 provided on the locking tab 152. As a result, the paper supporting members 102, 104 are prevented from sliding movement along the paper guide 106. Excessive counterclockwise rotation of the extended first paper support 112 is prevented by the projecting tabs 130 engaging the lower rear wall 146 of the base second paper support 114.

As shown in FIG. 1, the paper supporting members 102, 104 are spaced apart to provide an unsupported region 200 which is spanned by a central portion of the stack of individual sheets of paper to be fed from the paper tray 100. That is, the paper supporting members 102, 104 are adapted for providing generally only lateral side support for the stack of paper. As shown in FIG. 4, with the paper supporting member 102 empty, the bias spring 142 is operative for rotating the paper pressing plate 116 counterclockwise about hub 170, as received within the J-shaped bearing member 143 until engaged by the paper feed roller 120. As shown in FIG. 3, the planar support 126 of the extended first paper support 112, contoured support 138 of the base second paper support 114, and planar support 162 of the paper pressing plate 116 provide a concave surface for supporting a stack of paper to be fed from the paper tray 100. To supply or replenish a stack of paper to the paper tray 100, the control arm 188 of the control assembly 124 is depressed so as to rotate the lever 182 in a clockwise direction as viewed in FIG. 5. As a result, the control rod 118 is rotated about its eccentric axis 180 such that its leading edge presses downwardly upon the raised pad 172 provided on the brackets 168 of the base second paper support 114. Continued rotation of the control rod 118 is causes the paper pressing plate 116 to be rotated clockwise, as viewed in FIGS. 3 and 4, about the hub 170 until the planar support 162 is generally in alignment with the contoured support 138 of the base second paper support 114. Optionally, the control assembly 124 may be provided with a locking mechanism to maintain the paper pressing plate 116 in the loading position.

A stack of paper, having a width corresponding to the spaced apart distance between the upstanding side walls 132, 144 of the paper supporting members 102, 104, is now positioned into the paper tray 100. That is, the lateral sides of the stack of paper are supported by the respective planar support 126 of the extended first paper support 112, the contoured support 138 of the base second paper support 114, and planar support 162 of the paper pressing plate 116. The stack of paper is therefore unsupported in the region 200 between the paper supporting members 102, 104. Upon release of the control assembly 124, the paper pressing plate 116 is rotated counterclockwise about hub 170 by action of the bias spring 176. The counterclockwise rotation is continued until the top sheet of paper from the stack is engaged with the lower portion of its associated paper feed roll 120. The stack of paper, by being supported by the planar support 126, contoured support 138 and planar support 162, has assumed a concave shape thereby providing the stack with rigidity so as to be self-supporting in the region 200 between the spaced apart paper supporting members 102, 104. As a result of the construction of the paper supporting members 102, 104, it is not required to provide a separate support in the region 200 for a stack of paper to be fed from the paper tray 100.

As a result of the foregoing, the construction of the paper tray 100 is greatly simplified and one which readily lends itself to accommodating stacks of individual sheets of paper having different widths or size. As individual sheets of paper are fed from the stack, the paper pressing plate 116 is rotated counterclockwise towards the paper feed roller 120 to maintain engagement with the top sheet of paper. In this regard, the planar support 162 of the paper pressing plate 116, by being rotated upwardly about the hub 170, provides a greater concave shape to the stack of paper to provide increasing mechanical strength in the unsupported region 200 as the stack of paper progressively gets thinner due to the feeding of individual sheets of paper therefrom.

As the paper pressing plate 116 is rotated counterclockwise under the action of the bias spring 176, the pad 172 is pressed against the leading edge of the control rod 118 for rotating the control rod in a counterclockwise direction about the eccentric axis 180. The space 181 provided between the control rod 118 and brackets 168 prevents the brackets from engaging that portion of the control rod directly underlying the eccentric axis 180, which would prevent complete counterclockwise rotation of the paper pressing plate until the last sheet of paper was fed from the paper tray 100. As the stack of individual sheets of paper is depleted, the friction pad 166 by its contact with the bottom sheet of paper, prevents sliding of the stack within the respective paper supporting members 102, 104. As shown in FIG. 1, the control assembly 124 is provided with a pair of control arms 188. One control arm is adapted for operation of the paper tray 100 as shown. The other control arm 188 is adapted for operation of a second paper tray (not shown) which would be arranged underlying the paper supporting members 102, 104 in a similar construction, Individual sheets of paper can be fed alternatively from either of the paper trays upon selective operation of the corresponding paper feed shafts 122. Each of the paper trays 100 may be provided for accomodating a different kind of paper, as well as paper having a different width. In this regard, as the paper supporting members 102, 104 are slid along the paper guide 106, the position of their associated paper feed rollers 120 are maintained in proper alignment overlying the paper pressing plate 116 in the region of the friction pads 166. This is achieved by the double flange portion 194 of the paper feed rollers 120 being received by the recessed edges 196 on the upstanding side walls 144 of the base second paper supports 114. That is, the paper feed rollers 120 are adapted for sliding movement longitudinally along the paper feed shaft 122, concurrently with the corresponding paper supporting members 102, 104.

Although the invention herein has been described with reference to particular embodiments, it is to be understood that these embodiments are merely illustrative of the principles and application of the present invention. It is therefore to be understood that numerous modifications may be made in the illustrative embodiments and that other arrangements may be devised without departing from the spirit and scope of the present invention as defined in the appended claims.

What is claimed is:

1. A paper tray for storing a stack of individual sheets of paper to be fed therefrom to a printing device, said paper tray comprising first paper supporting means for supporting one lateral portion of said stack, second paper supporting means for supporting another lateral portion of said stack, and a support guide movably supporting said first and second paper supporting means in spaced-apart relationship to accommodate stacks of individual sheets of paper having different widths between their lateral portions, said first paper supporting means including a first paper support having a first member and a second member paper support having a second member, said first paper support pivotally attached to said second paper support between a locked and unlocked position, said first member engaging said second member when said first paper support is in said locked position to prevent movement of said first paper supporting means along said support guide and said first member disengaging from said second member when said first paper support is in said unlocked position to permit movement of said first paper supporting means along said support guide.

2. The paper tray of claim 1 wherein said first paper supporting means and said second paper supporting means each provide a concave paper supporting surface, whereby said stack supported by said concave paper supporting surface assumes a concave shape to be self-supporting in an unsupported region between said first and second paper supporting means.

3. The paper tray of claim 2 wherein said first and second paper supports each have an upstanding side wall arranged in alignment with one another to provide a side abutment for a supported lateral portion of said stack.

4. The paper tray of claim 1 wherein said second paper supporting means includes a third paper support and a fourth paper support, said third and fourth paper supports pivotally attached to one another.

5. The paper tray of claim 4 wherein said paper supports of said first and second paper supporting means each have an upstanding side wall arranged in alignment with one another to provide a pair of spaced-apart abutments for the supported lateral portions of said stack.

6. The paper tray of claim 1 wherein said support guide includes a longitudinally extending channel, and said second member includes a guide rib received within said channel for retaining said second paper support on said support guide during the movement thereof.

7. The paper tray of claim 1 wherein said support guide includes a longitudinally extending channel and said first and second paper supporting means includes a guide rib received within said channel for retaining said first and second paper supporting means on said support guide during the movement thereof.

8. The paper tray of claim 1 wherein said first member comprises a projection and said second member comprises a locking tab.

9. The paper tray of claim 8 wherein said locking tab includes a bulge for engaging said projection when said first paper support is in said locked position.

10. The paper tray of claim 8 wherein said second paper supporting means includes a third support having a projection and a fourth paper support having a locking tab, said third paper support pivotally attached to said fourth paper support between a locked and unlocked position, said projection engaging said locking tab when said third paper support is in said locked position to prevent movement of said second paper supporting means along said support guide and said projection disengaging from said locking tab when said third paper support is in said unlocked position to permit movement of said second paper supporting means along said support guide.

11. The paper tray of claim 10 wherein said locking tabs of said second and fourth paper supports each include a bulge for engaging a respective one of said projections when said first and third paper supports are in said locked positions.

12. The paper tray of claim 11 wherein said support guide includes a longitudinally extending channel and said locking tabs of said second and fourth paper supports each include a guide rib received within said channel for retaining said second and fourth paper supports on said support guide during the movement thereof.

13. The paper tray of claim 1 further including paper feeding means for feeding individual sheets of paper from said stack, paper pressing means movably mounted about a first axis, said paper pressing means movable about said first axis towards said paper feeding means for urging said stack into engagement therewith and away from said paper feeding means for supplying individual sheets of paper to said stack, and control means movable about a second axis spaced from said first axis, said control means engaging a portion of said paper pressing means for moving said paper pressing means about said first axis and away from said paper feeding means.

14. The paper tray of claim 13 wherein said control means comprises a longitudinally extending rod rotationally mounted about an eccentric axis, said eccentric axis corresponding to said second axis.

15. The paper tray of claim 14 wherein said paper pressing means includes a pad for engaging a portion of said rod remote from said eccentric axis.

16. The paper tray of claim 15 wherein said pad comprises a raised portion of said paper pressing means, said raised portion preventing engagement of an adjacent portion of said paper pressing means with a portion of said rod proximate said eccentric axis.

17. The paper tray of claim 13 further including biasing means for biasing said paper pressing means towards said paper feeding means.

18. The paper tray of claim 13 further including means for moving said control means about said second axis for engaging said paper pressing means.

19. The paper tray of claim 13 wherein said paper pressing means is constructed and arranged for movement about said first axis towards said paper feeding means while said first paper support remains stationary.

20. The paper tray of claim 13 wherein said second paper support includes a J-shaped bearing member.

21. The paper tray of claim 20 wherein said paper pressing means includes a hub received by said J-shaped member for rotation of said paper pressing means about an axis of said hub, said axis of said hub corresponding to said first axis.

* * * * *